US005368718A

United States Patent [19]

Conrod et al.

[11] Patent Number: 5,368,718

[45] Date of Patent: Nov. 29, 1994

[54] ELECTROWINNING OF DIRECT METALLIZATION ACCELERATORS

[75] Inventors: Jay B. Conrod, Cheshire; Paul Menkin, Branford; Durand A. Cercone, Cheshire, all of Conn.

[73] Assignee: Enthone-OMI, Inc., West Haven, Conn.

[21] Appl. No.: 120,510

[22] Filed: Sep. 13, 1993

[51] Int. Cl.[5] ..... C25D 21/18

[52] U.S. Cl. ..... 205/101; 204/120

[58] Field of Search ..... 204/120, 121, 122, 130; 205/101

[56] References Cited

U.S. PATENT DOCUMENTS

| | | | |
|---|---|---|---|
| 3,532,518 | 10/1970 | D'Ottavio | 106/1 |
| 4,052,276 | 10/1977 | Yoshida et al. | 205/101 |
| 4,853,095 | 8/1989 | D'Ambrisi | 204/82 |
| 4,859,300 | 8/1989 | Sullivan et al. | 204/164 |

*Primary Examiner*—John Niebling
*Assistant Examiner*—Edna Wong
*Attorney, Agent, or Firm*—DeLio & Peterson

[57] ABSTRACT

A specially controlled electrolytic process for regenerating for reuse solutions such as the post activator solution used in the direct metallization process for making printed circuit boards is disclosed whereby the contaminant tin level of the operating solution is controlled at desired levels.

5 Claims, No Drawings

ELECTROWINNING OF DIRECT METALLIZATION ACCELERATORS

BACKGROUND OF THE INVENTION

This invention relates to a method for the direct metal plating of nonconductive substrates and, in particular, to the regeneration of solutions used in the plating process.

The metal plating of plastics and other nonconductive (dielectric) substrates is well-known in the art and the following description will be directed for convenience to plastics, especially epoxy, and the preparation of printed circuit boards.

The preparation of printed circuit boards requires the plating of conductive metal layers, usually copper, onto the plastic substrate of the board. These boards vary in design and may have a copper layer on each surface of the epoxy (two-sided boards) or they can be multi-layer boards which have a plurality of inter-leaved parallel planar copper and epoxy layers. In both types, through-holes are drilled in the board and metal plated to facilitate connection between the circuits on the copper layers.

In general and for purposes of illustration, the electroless metal plating method for the manufacture of through-hole printed circuit boards is a sequence of steps commencing with a commercially available copper clad laminate or multi-laminate made from, e.g., paper-epoxy, glass-epoxy di, multi or tetrafunctional epoxy, or glass polyimide material. A predesigned series of through-holes is formed in the board in any conventional manner (e.g. drilled and deburred), then preferably treated to clean and condition the plastic for adhesion and activation of the metal plating using a swell and etch technique. The board is now ready for electroless metal plating using conventional procedures.

A preferred step before plating, if not done previously, is to dissolve some of the glass fibers in the epoxy using, for example, acid fluorides, and then to pretreat the board by cleaning and conditioning with a composition such as ENPLATE ®PC-475 to remove hydrocarbon soils and oxides and to enhance the surface for activation. The surface may also be microetched to enhance copper to copper adhesion. Thereafter the board is immersed in a catalyst, such as a tin-palladium solution, which activates the surface of the epoxy for electroless copper plating. ENPLATE Activator 444 sold by Enthone-OMI, Inc., West Haven Conn., is exemplary of this type catalyst. Following a water rinse, the laminate is immersed in an accelerator such as ENPLATE PA-491 to activate the catalyst by exposing the metal palladium ions on the board. After a water rinse, the board is dried and is immersed in an electroless copper plating solution for a period of time sufficient to plate copper to the desired thickness on the board surfaces and the through-hole connections. ENPLATE CU-700 and other similar plating compositions may be employed. The boards may then be electroplated using conventional techniques to provide a thicker final coating.

The above procedure, however, is time consuming and costly and it is preferred to improve the process by eliminating the need for electroless copper plating of the board prior to electrolytic plating. This process is generally known as direct metallization and in a commercial direct metallization process, after the drilling, deburring and cleaning steps, the board is conditioned using an adhesion promoter such as an alkaline permanganate solution, followed by treating with a cleaner conditioner (such as ENVISION DPS-5625) to remove oxides and oils and promote absorption of colloid. Activation is a two-step procedure consisting of a pre-dip to prevent contamination of the activator by drag-in (such as ENVISION DPS Carrier 5630) followed by contacting the board with a proprietary noble metal containing catalyst which is adsorbed onto the board. The catalyzed board is now specially treated with a proprietary post activator (also known as accelerators or generators) to leave a highly conductive and catalytic surface and a final acid wash stabilizes the conductive film. The board may now be directly metal plated by electrolytic plating. The board may also be electrolessly plated, e.g., flash coated, although for most applications this step is not performed and the board directly electrolytically plated.

Unfortunately, when the catalyzed board (palladium and tin are usually the catalysts) is treated with the post activator some of the tin is dissolved and builds up in the post-activator solution. The use of tin "contaminated" solutions has been found by us to adversely affect the subsequent electrolytic plating and the tin level is generally controlled by diluting with fresh post-activator solution (feed and bleed) or by bail out of the old solution and replenishment with fresh solution. These methods are costly and environmentally unsound and new methods are needed.

It is an object of the invention to provide an improved direct metallization process by regenerating for reuse the post-activator solutions used in the direct metallization process.

It is a further object of the invention to provide a method for regenerating for reuse the post-activator solution used in direct metallization processes.

Other objects and advantages will be apparent for the following description.

SUMMARY OF THE INVENTION

It has now been discovered that materials used to treat the catalyzed surfaces in the direct metallization process for plating nonconductive substrates such as plastics may be regenerated for reuse by using an electrolytic process, e.g., electrowinning, to remove contaminant ions such as tin. In one embodiment, the regeneration process of the invention is performed by the use of an anode and cathode in the post-activator bath and carrying out the electrolysis in the tank used to hold the post-activator bath after the workpieces (boards) are removed from the bath. The bath to be regenerated may after the workpieces are removed from the bath also be transferred either batchwise or continuously to a separate cell for electrowinning and the regenerated (electrowon) post-activator solution recycled either batchwise or continuously to the post-activator bath cell.

DETAILED DESCRIPTION OF THE INVENTION

Any suitable catalytic metal containing activator solution, e.g., a noble metal, may be employed to catalyze the substrate to be plated and generally the activator is the well-known stabilized reaction product of stannous chloride and palladium chloride which is sold dry or as a concentrated solution in HCl. The older two-step process consisted of separate HCl solutions of stannous chloride and palladium chloride and may be employed but is not preferred because it is not economical for most uses. Other precious metals may be used but are generally not cost effective. Exemplary activator compositions are shown in U.S. Pat. Nos. 3,011,920; 3,532,518 and 3,672,938. In general, a commercial activator composition contains 0.1–1 g/l $PdCl_2$, 20–50 g/l $SnCl_2$ and 15–50 g/l HCl.

Another activator type composition is disclosed in U.S. Pat. No. 4,933,010, which patent is hereby incorporated by reference. In this patent, a concentrated HCl free activator for chemical plating is shown which contains stannous chloride, and palladium chloride colloidally dispersed in an aqueous solution of saturated sodium chloride. Preferably the activator includes 5 to 10 g/l of stannous chloride, 0.1 to 0.2 g/l of palladium chloride, 0.05–10 volume/volume percent of sulfuric acid, and 50–280 g/l of sodium chloride, and optionally, 0.015–0.03 g/l vanillin.

Another preferred activator because of its demonstrated effectiveness is termed ENVISION DPS Activator 5635 sold by Enthone-OMI, Inc., and contains palladium chloride, stannous chloride, sodium chloride, HCl and resorcinol. A composition comprising 9% by volume DPS 5635,200 g/l NaCl, 5 ml/l HCl 37% has been found to provide excellent results.

While any suitable catalytic metal containing activator solution may be employed to catalyze the substrate, it is important that the activated resin be treated at an effective temperature for a suitable time with an effective post-activator solution in order to obtain the surface conductivity on the resin needed to electrolessly or electrolytically plate the resin.

Post-activation of activated resins for electroless plating is well-known in the art and it is generally accepted that this step modifies the surface layer of the palladium nuclei, and stannous and stannic hydrous oxides and oxychlorides. Any acid or alkaline solutions in which excess tin is appreciably soluble and catalytic palladium nuclei become exposed have been employed in the prior art. In general, a resin activated with a commercial palladium-tin-HCl solution is post-activated with dilute sulfuric acid (10% by volume) by immersion for about 5 minutes at room temperature.

While the above-conventional procedures have been acceptable to prepare the resin for electroless plating, it has been found that specially formulated post-activator solutions need to be employed to provide the resin surface with the conductivity (measured as resistivity) needed to be electrolytically plated or even electrolessly plated for some difficult to plate situations, e.g., a no flash additive process. In general, it is important that the resistivity of the resin surface be less than about 250 ohms, preferably less than about 100 ohms and most preferably less than about 20 ohms or even 10 ohms. The resistivity is measured by side to side contact of a printed circuit board with conductivity meter pins. Using the conventional steps for electroless plating as noted above, the resistivities obtained are typically above about 1000 ohms.

Broadly stated, the post-activator solutions are alkaline solutions having a pH greater than about 10 and comprise an effective amount of ions which solubilize some of the tin resulting in a build-up of tin in the activator solution. An exemplary solution is ENVISION DPS Generator 5640 sold by Enthone-OMI.

To practice the method of the invention the conditioned and activated plastic substrate is contacted with the post-activator composition at an elevated temperature for a time sufficient to render the surface sufficiently conductive for electrolytic plating. Contacting procedures may vary widely and satisfactory results for epoxy resin are provided by immersing the part in the activator solution for 5 to 15 minutes at 3520 to 50 ° C. or higher. Contacting of the resin in the post-activator solution is also about 5 to 15 minutes, preferably 8 to 12 minutes, at 50° to 90° C. or higher, preferably 55° to 70° C. The times and temperatures may be longer and/or lower or higher than noted above and will vary depending on the substrate being treated and the compositions of the solutions as will be appreciated by those skilled in the art. Other means such as spraying, dipping or flooding may be used for activating and/or post-activating the plastic part.

The substrate is now preferably contacted with an acid solution to, it is hypothesized, stabilize the post-activated surface and prevent formation of stannate ions. A 10% by volume acidic solution used at room temperature for up to about 3 minutes has been found to provide excellent results and a level of up to about 20% by volume or higher may be employed. Suitable acids such as sulfuric, acetic, etc. may be employed. An exemplary solution is ENVISION DPS Stabilizer 5645.

The substrate may now be metal plated using conventional electroless or electrolytic baths such as EN-PLATE CU-944 and Cubath$^R$ products such as XR 235A and XR 235B sold by Enthone-OMI. Before plating however, the board may be further processed using standard techniques to image the boards using, for example, conventional primary image resists. It is also preferred to microetch the board to improve copper to copper adhesion using a material such as ENVISION DPS Micro Etch 5655.

At the point in the manufacturing process where the printed circuit board is treated with the post-activator solution, the board is typically immersed in a bath of the solution for the time needed to achieve the desired conductivity effect. Usually the boards are connected to plating racks which hold a multiplicity of the boards and numerous racks may be used simultaneously in the bath.

The bath may be contained in a tank made of any suitable conductive anodic material which is generally resistant to the post-activator solution to avoid, e.g., dissolution or corrosion of the tank. Preferably, a non-conductive tank may be employed such as polypropylene, with a conductive material used in the solution as the anode of the electrolysis circuit. The cathode will likewise be any suitable conductive material and will also be in contact with the post-activator solution to form the electrolysis circuit. Generally, a rack (grid) of alternating anodes and cathodes is prepared and inserted into the tank when the regeneration process is performed. Suitable materials include stainless steel, platinum and copper with copper being preferred as both the anode and the cathode.

The anode and cathode may for certain processes be in contact with the working bath and the electrolysis performed during the post-activation process but it is preferred that other suitable methods of electrolyzing the solution be employed. For example, a rack of anodes and cathodes may be inserted into the bath during shutdown (when there are no workpieces in the bath) or the solution may be intermittently (batchwise) or continually purged from the tank during post-activation or shut-down and treated in a separate electrolysis cell and returned to the tank. Make-up post-activator solution may be needed during the treatment process and the solution may be added as required as is well known in the art. Likewise, any solids formed during use of the bath, e.g., copper oxide, may be separated from the solution as desired.

A preferred process also employs agitation in the bath cell or separate electrolysis cell to help prevent depletion of ions at the electrodes, particularly tin ions at the cathode, and any form of mixing may be used, e.g., mechanical movement of the electrode rack. Additionally, the surface area of the cathode is preferably larger than the anode surface area to minimize undesirable reductive effects at the cathode. In general, a cathode to anode surface area ratio may be greater than 10:1 or higher and is preferably about 5:1 to 1:1, e.g., 2:1.

The operating temperature for the electrolysis step may vary widely and may be the same as the temperature used to treat the boards with the post-activator solution, e.g., about 55° to 70° C. Lower temperatures are preferably used when boards are not being treated (shut down) to achieve enhanced regeneration effects by minimizing side reactions which may cause the bath to become inactive (the effect of the bath is decreased and the subsequent copper coverage is adversely effected). For example, if it is desired to regenerate the bath during a time period when the bath is not being used, e.g., overnight, any suitable temperature may be employed. Generally, the operation temperature for this type situation is about 20° to 40° C., e.g., ambient. It has been found that if the bath is inactive after regeneration that activity may be regained if the bath is allowed to stand for up to 7 days, generally 3–7 days.

Cell voltage may also vary widely and is generally between about 1 to 20 volts. A preferred range is 2 to 5 volts. Current densities, similarly to electrolysis temperature, affect the activity of the regenerated solution and it is preferred to employ a cathode current density of about 0.1 to 20 amps/ft$^2$, with a range of about 1 to 5, e.g., 1 to 2, being preferred. Cathode current densities may be calculated from the anode/cathode surface areas.

In general, the electrolysis-process is performed for up to about 10 hours, usually 1 to 4 hours, e.g., 3–4 hours, although longer or shorter times may be used depending on the current density, temperature, percent reduction of contaminant tin desired, etc. Activity of the regenerated bath is effected by the above parameters and in general, the higher the temperature and/or higher the current density, the greater the adverse effect on the bath activity and, consequently, the longer the time needed to allow the bath to regain its activity by standing.

The need for using the electrolysis process will generally depend on the concentration of "contaminant" tin ions in the bath. Generally, the electrolysis is carried out when the tin concentration is less than about 100 ppm, preferably less than about 60 ppm. If the electrowinning is performed in situ the process continually electrolyzes the solution whereby the tin ions will be continually plated out (and removed from the bath) on the cathode surface. Numerous textbooks and articles describe electrolysis processes and it is contemplated herein that any such process (including varying parameters such as current density, temperature, etc.) may be suitably employed without departing from the scope of the invention. One such publication, which is hereby incorporated by reference is The Encyclopedia of Chemical Technology, Kirk-Othmer, Third Edition, Volume 14, pages 871–877.

The following examples are given for purposes of illustration only and are not to be considered as constituting a limitation on the present invention. All parts and percentages given are by weight and temperatures in degrees centigrade unless otherwise indicated.

EXAMPLE I

Printed circuit boards having through holes and copper on each surface thereof were processed as follows:

(a) conditioned by immersion in ENVISION DPS-5625 for 10 minutes at 80° C.;
(b) cold water rinse for 5 minutes;
(c) pre dip by immersion in ENVISION DPS Carrier 5630 for 1 minute at room temperature;
(d) activation by immersion in ENVISION DPS Activator 5635 at 46° C. for 10 minutes;
(e) cold water rinse for 3 minutes;
(f) post-activation by immersion in ENVISION DPS Generator 5640 at 63° C. for 10 minutes;
(g) cold water rinse for 1 minute;
(h) stabilization by immersion in ENVISION DPS Stabilizer 5645 at room temperature for 3 minutes; and
(i) cold water rinse for 1 minute.

An electrowinning cell was connected to the tank used for the post-activation step (f). The cell contained a total of 17 alternating anode and cathode copper plates each 8 inch×7 inch (cathode surface area to anode surface area of about 1:1). When the post-activator solution built up to 38 mg/l tin, the solution was continuously recycled between the post-activation tank and the electrowinning cell. At a cathode current density of 1 amp/ft$^2$ for 4 hours the level was decreased by 54% to 17 mg/l. The regenerated solution was then completely pumped back into the post-activation tank and printed circuit boards processed using the regenerated solution were copper electroplated with excellent coverage and adhesion.

EXAMPLE II

Steps (a)–(i) of EXAMPLE I were repeated and boards were processed until 569 ft$^2$ (or 22.8 ft$^2$/gal) of board were run through the process. 26 racks of boards were processed and the resistances of the activated surfaces as tested by side to side measurement using a Fluke 88842A Multimeter ranged from <1 ohm to about 3 ohms. The final tin concentration of the post-activator bath was 54 ppm. A board from rack 22 had a resistance of 1 ohm and commercial copper coverage after 1 mil acid copper plate. The tin level at this point was 44 ppm. A rack 26 board had a resistance of less than 1 ohm but the copper coverage had a few small epoxy voids visible by back light examination. The tin level of the bath at this point was 54 ppm and these boards were commercially unacceptable.

The post-activator bath was electrolyzed in the post-activator tank by placing a rack of alternating copper anodes and cathodes therein. The cathode:anode surface area ratio was about 2:1. Electrolysis was conducted for 1.5 hours at 63° C. and 1 amp/ft$^2$ cathode current density and the tin level was decreased 17% to 45 ppm. Copper level was also decreased 9% to 78 ppm.

The cathode plates were then replaced with new copper plates and electrolysis performed for 3 hours at 3 amps/ft$^2$ cathode current density. The results are as follows:

| Time (Hours) | Tin (ppm) | Copper (ppm) |
|---|---|---|
| Start (0) | 45.5 | 75.6 |
| 0.5 | 40.6 | 69.1 |
| 1.0 | 35.5 | 61.4 |
| 1.5 | 32.4 | 56.3 |
| 2.0 | 30.1 | 49.4 |
| 2.5 | 25.7 | 44.8 |
| 3.0 | 23.3 | 39.5 |

Boards processed after the electrolysis using the regenerated solution had commercial copper coverage.

While the process of the present invention has been disclosed and described with respect to certain preferred embodiments, it will be appreciated by those skilled in the art that various modifications may also be used. For example, it is contemplated herein that the electrolysis process be performed in situ, i.e., by conducting the electrolysis in the post-activator tank simultaneously with the post-activation treatment of the substrate. Additionally, the electrolysis may be performed in a separate electrowinning cell with the solution recycled between the post-activation cell and the electrowinning cell simultaneously with the post-activation step.

It will be apparent that many changes and modifications of the several features described herein may be made without departing from the spirit and scope of the invention. It is therefore apparent that the foregoing description is by way of illustration of the invention rather than limitation of the invention.

We claim:

1. A method for regenerating for reuse a post-activator solution used in a process for the direct metallization of nonconductive substrates wherein a noble metal-tin containing solution is contacted with the substrate to activate the substrate and the activated substrate contacted with a post-activator solution to increase its conductivity for plating thereon comprising electrolyzing the used post-activator solution which comprises noble metal, copper and tin, the tin being in an amount less than about 100 ppm to decrease the level of tin in the solution.

2. The method of claim 1 wherein the electrolysis is performed at a cathode current density of about 0.5 to 20 amps/ft$^2$ at a temperature of from room temperature to 90° C.

3. The method of claim 2 wherein the electrolysis is performed using a cathode to anode surface area ratio of about 1:1 to 5:1.

4. The method of claim 1 wherein the regeneration is performed continuously during the post-activation process.

5. The method of claim 1 wherein the regeneration is performed during shut down of the post-activation process.

* * * * *

UNITED STATES PATENT AND TRADEMARK OFFICE

CERTIFICATE OF CORRECTION

PATENT NO. : 5,368,718

DATED : November 29, 1994

INVENTOR(S) : Jay B. Conrod, Paul Menkin & Durand A. Cercone

It is certified that error appears in the above-identified patent and that said Letters Patent is hereby corrected as shown below:

Column 4, line 5, "3520" should read - -35- -.

Signed and Sealed this

Seventh Day of February, 1995

*Attest:*

BRUCE LEHMAN

*Attesting Officer*

*Commissioner of Patents and Trademarks*